US008607859B2

(12) United States Patent
Eriksen

(10) Patent No.: US 8,607,859 B2
(45) Date of Patent: Dec. 17, 2013

(54) METHOD OF DRILLING AND RUNNING CASING IN LARGE DIAMETER WELLBORE

(71) Applicant: Erik P. Eriksen, Calgary (CA)

(72) Inventor: Erik P. Eriksen, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 811 days.

(21) Appl. No.: 13/645,880

(22) Filed: Oct. 5, 2012

(65) Prior Publication Data

US 2013/0025850 A1 Jan. 31, 2013

(51) Int. Cl.
*E21B 7/20* (2006.01)
*E21B 33/13* (2006.01)

(52) U.S. Cl.
USPC ..... 166/177.4; 166/289; 175/171

(58) Field of Classification Search
USPC ..... 175/171; 166/289, 177.4
See application file for complete search history.

(56) References Cited

U.S. PATENT DOCUMENTS

| | | | | |
|---|---|---|---|---|
| 1,295,969 | A | 3/1919 | Carmichael | |
| 3,672,447 | A | 6/1972 | Kofahl | |
| 4,083,405 | A * | 4/1978 | Shirley | 166/285 |
| 6,854,533 | B2 | 2/2005 | Galloway et al. | |
| 6,857,487 | B2 | 2/2005 | Galloway et al. | |
| 7,093,675 | B2 | 8/2006 | Pia | |
| 7,108,080 | B2 | 9/2006 | Tessari et al. | |
| 7,234,546 | B2 | 6/2007 | Vincent et al. | |
| 7,311,148 | B2 | 12/2007 | Giroux et al. | |
| 2007/0175665 | A1 | 8/2007 | Tessari et al. | |
| 2007/0267221 | A1 | 11/2007 | Giroux et al. | |
| 2009/0090508 | A1 | 4/2009 | Brouse | |

FOREIGN PATENT DOCUMENTS

| | | | |
|---|---|---|---|
| WO | 2006012186 | A1 | 2/2006 |
| WO | 2007011906 | A1 | 1/2007 |

OTHER PUBLICATIONS

Office Action in corresponding Canadian Application No. 2772836 dated Oct. 11, 2013 (3 pages).
Examination Report in corresponding United Kingdom Application No. GB1203831.1 dated May 29, 2013 (2 pages).

* cited by examiner

*Primary Examiner* — Giovanna Wright
(74) *Attorney, Agent, or Firm* — Osha Liang LLP

(57) ABSTRACT

A well is drilled and casing installed utilizing a casing drilling technique. A bottom hole assembly having a drill bit and a fluid diverter is secured to a string of drill pipe and installed within a casing string. Drilling fluid is pumped down the drill pipe string to cause the drill bit to rotate and drill the well while the fluid diverter is in a drilling mode position. At the total depth for the casing string, the operator moves the fluid diverter to a cementing position and pumps cement down the drill pipe and up the casing string annulus. After cementing, the operator moves the fluid diverter to a packer set position and again pumps drilling fluid down the drill string to set the packer.

6 Claims, 9 Drawing Sheets

Fig. 5
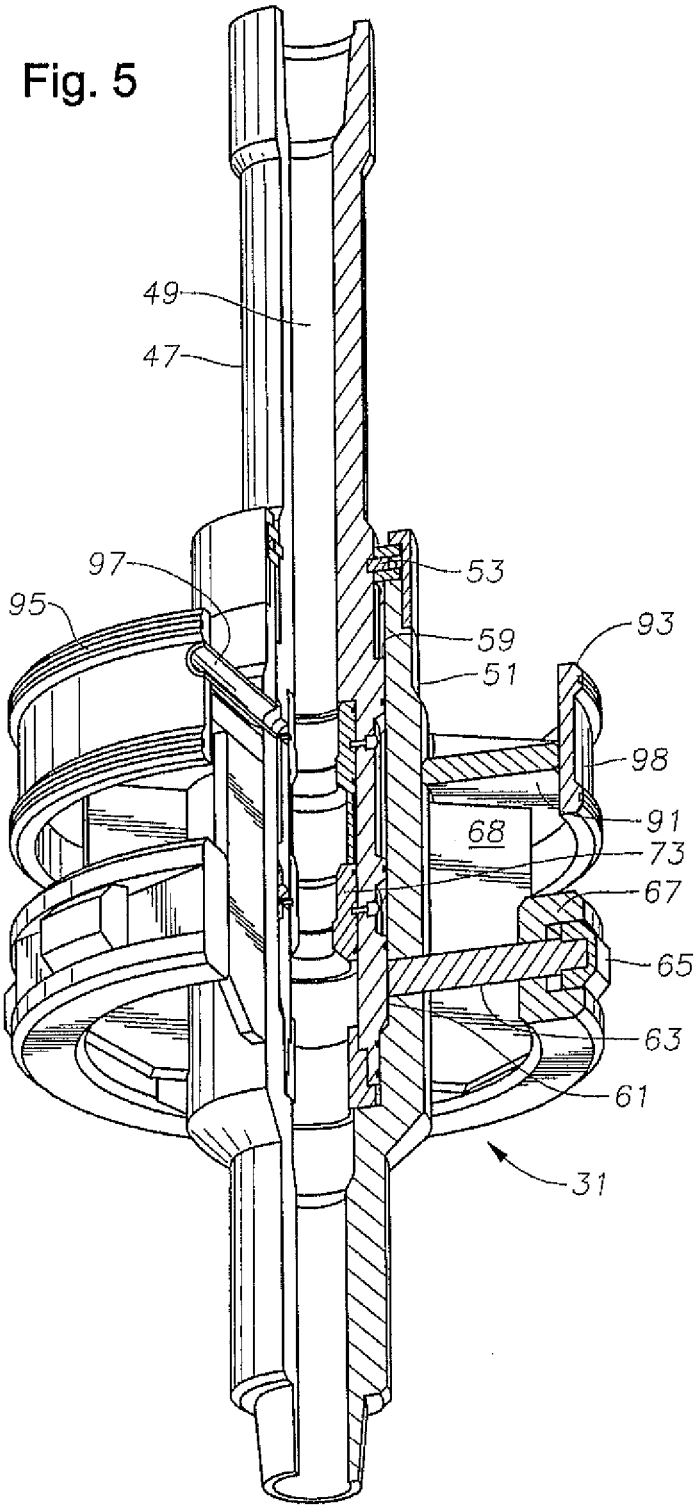
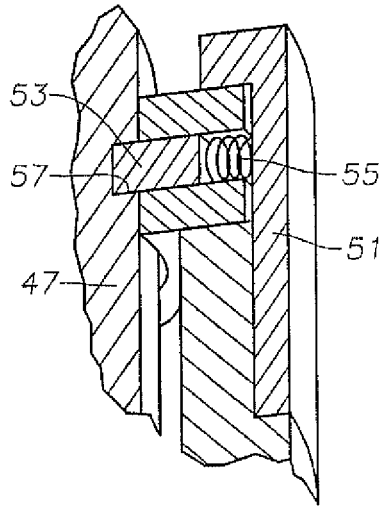
Fig. 6

METHOD OF DRILLING AND RUNNING CASING IN LARGE DIAMETER WELLBORE

CROSS-REFERENCE TO RELATED APPLICATION

This application, pursuant to 35 U.S.C. §120, claims benefit to U.S. patent application Ser. No. 12/554,185, filed Sep. 4,2009, now U.S. Pat. No. 8,281,878, which is incorporated by reference in its entirety.

FIELD OF THE INVENTION

This invention relates in general to well drilling operations, and in particular to a method of drilling and running casing simultaneously in large diameter wellbores.

BACKGROUND OF THE INVENTION

Normally wellbores for well and gas wells have a larger diameter or surface easing portion at the upper end that will be cased by a first string of casing. One or more strings of casing are subsequently installed with each string of casing being smaller in diameter. The first string of casing in a subsea well may be as large as 36" in diameter. Typically, the operator jets or washes the first casing string into the seabed to a depth of about 400 feet. The operator accomplishes this installation by pumping fluid down the casing string to wash out the seabed as the casing is lowered. The surrounding formation settles in and around the casing string, holding it in place. The operator may also cement the first string of casing.

A subsea outer wellhead housing may be located at the upper end of the first string of casing on the sea floor. In other techniques, the first string of casing extends upward to a fixed platform above the sea level, and a wellhead housing is attached to the casing at the platform. The operator drills through the first string of casing to a second depth, then installs a second string of casing. The operator may repeat this process, installing a third or more strings of casing.

In some cases, having a longer first string of casing is desirable, such as one having a depth of about 1500 feet. A deeper first string of casing is helpful particularly for deep wells. However, increasing the depth of the first string of casing in subsea wells is not easy to achieve by jetting or washing down a large diameter string of pipe.

Techniques other than jetting or washing down surface casing are known. For example, operators normally install the first string of casing in land-based wells by first drilling the wellbore with a drill bit, then lowering the first string of casing string into the well and cementing it in place. The first string of casing for a land-based well is normally not as large as the first string of casing of a subsea well.

Although not typically done offshore, casing, include a first string of casing, may also be installed simultaneously as the well is being drilled. In this technique, the operator installs a bottom hole assembly at the lower end of a string of casing being made up. The bottom hole assembly includes a drill bit and a locking mechanism that locks the bottom hole assembly to the casing string for rotation in unison with each other. The operator grips the upper end of the casing string with a casing gripper. The top drive supports and rotates the casing gripper and the casing string, causing the drill bit to rotate to drill the well. When reaching a desired depth, the operator optionally may retrieve the bottom hole assembly while the casing remains in the well. The operator then cements the easing in place.

Casing while drilling becomes difficult in the case of very large diameter casing. One reason is that large diameter casing may not have the strength to transmit the necessary torque throughout its length. The friction between the large diameter casing string and the borehole sidewall can be high.

Mud motors are sometimes used in drill strings for causing rotation of the drill bit relative to the drill pipe. A mud motor operates in response to drilling fluid pumped down the drill pipe string. Mud motors are particularly useful for drilling horizontal or directional wells. Mud motors may also be installed in a bottom hole assembly of a casing drilling assembly. The reactive torque caused by the mud motor can be transmitted back to the casing string, which may be maintained in a non-rotating position. Rotating the casing string while casing drilling, however, is desirable to smear and condition the mudcake on the borehole walls. Thus, the operator typically will rotate the casing string at the same time the mud motor is operating. The casing will rotate in the same direction but at a slower speed than the mud motor, if so. The operator causes the casing string to rotate by rotating the casing gripper with the top drive.

During casing while drilling of land-based wells, the upper end of the string of casing will be located at the drilling rig and gripped and rotated by a casing gripper. Extending the upper end of the string of casing to the drilling rig during a casing drilling operation may not be feasible for an offshore well located in deep water. If the upper end of the casing string, once installed, is to be supported by a subsea wellhead assembly, the operator would not want the upper end of the casing string to extend any higher than the subsea wellhead assembly. Otherwise, the operator would have to unscrew each joint of casing extending above the subsea wellhead assembly, and the sea floor may be thousands of feet deep.

Liner drilling is another technique involving deploying a string of casing while drilling. A liner string is made up of joints of pipe that are the same as casing and which are cemented in the well. A difference is that the liner string extends only a short distance above the lower end of the previously installed casing string. Casing strings, cm the other hand, extend to the top of the well. In liner drilling, a selected length of casing is made up with a bottom hole assembly having a drill bit. The liner is deployed on a string of drill pipe, and rotation is imparted to the liner string by the string of drill pipe. The drill pipe may connect to the upper end of the liner string and transmit torque through the liner string to the bottom hole assembly. Alternately, the drill pipe may extend concentrically within the liner string to the bottom hole assembly. The liner string is mounted to the drill pipe for rotation with the drill pipe, thus some of the torque would pass through the liner string and some through the drill pipe to the bottom hole assembly.

SUMMARY OF THE INVENTION

In one embodiment of the invention, the operator makes up a casing string and secures a drill pipe string to a bottom hole assembly. The bottom hole assembly has an earth boring bit and a fluid diverter. The fluid diverter has a drilling position and a cementing position. While in the drilling position, the operator rotates the drill bit to drill the well, and pumps drilling fluid down the drill pipe string while the fluid diverter is in a drilling mode position. In the drilling position, the drilling fluid flows through the drill pipe to the bottom hole assembly and out the drill bit.

When reaching a total depth of the casing string, the operator moves the fluid diverter to the cementing position and pumps cement down the drill pipe. The cement flows out the drill pipe string above the drill bit and up the casing string annulus on the exterior of the casing string. The operator then retrieves the bottom hole assembly from the casing string.

In one technique, the operator moves the fluid diverter to the cementing position by conveying a sealing member into the drill pipe string passage, which lands in the fluid diverter to block flow through the drill pipe to the bottom hole assembly and direct the cement along a cement path to the casing string annulus.

In another embodiment, the operator installs a packer in the casing string while the casing string is being made up. After dispensing the cement and before retrieving the bottom hole assembly, the operator moves the flow diverter to a packer set position and pumps fluid down the drill string to set the packer. The packer extends outward to seal the casing string annulus, preventing cement in the casing string annulus from flowing downward.

In one technique, the operator moves the fluid diverter to the packer set position by conveying another sealing member down the drill pipe string passage, which lands in the fluid diverter to block flow along the cement path and direct downward flow to the packer to set the packer.

In another embodiment of the invention, the fluid diverter has a barrier that seals against the inner diameter of the casing string to block upward return flow within the interior of the casing string. In this embodiment, the fluid diverter includes a bypass port and a bypass valve that will selectively allow drilling fluid to be returned up the interior of the casing. Moving the fluid diverter from the drilling position to the cementing position preferably automatically closes the bypass port.

In another embodiment of the invention, the bottom hole assembly has a mud motor that is driven by drilling fluid pressure. The operator rotates the drill bit with the mud motor. The operator transmits reacting torque caused by the mud motor to the casing string. The upper end of the casing string is preferably not attached to the drill pipe for rotation therewith, thus the drilling torque is not transferred to the casing string. The operator causes the reacting torque to rotate the casing string in reverse, but controls the rate of rotation in the reverse direction by applying a braking force to the drill pipe string. The braking force may be applied by a top drive of the drilling rig. This technique of causing the casing string to rotate in reverse to the drill bit may be employed for liner drilling as well as casing drilling, both offshore and on land.

Causing reverse rotation of the casing string by utilizing the torque of a mud motor can also be employed with casing drilling operations whether or not a fluid diverter is employed. In this instance, the bottom hole assembly may be land and lock in the casing string without any drill pipe attached to it. The operator connects the upper end of the casing string to a casing gripper support by a top drive. The reverse torque applied to the casing string extends up the casing string to the casing gripper and top drive. The top drive applies a braking action to the reverse rotation of the casing string.

BRIEF DESCRIPTION OF THE DRAWINGS

FIG. 5 is a perspective view of the fluid diverter of FIG. 4, shown detached from the packer.

FIG. 6 is an enlarged sectional view of an upper portion of the housing of the fluid diverter of FIG. 4, illustrating a shear pin that holds the torque keys of the fluid diverter in an engaged position.

DETAILED DESCRIPTION OF THE INVENTION

Figure 1:
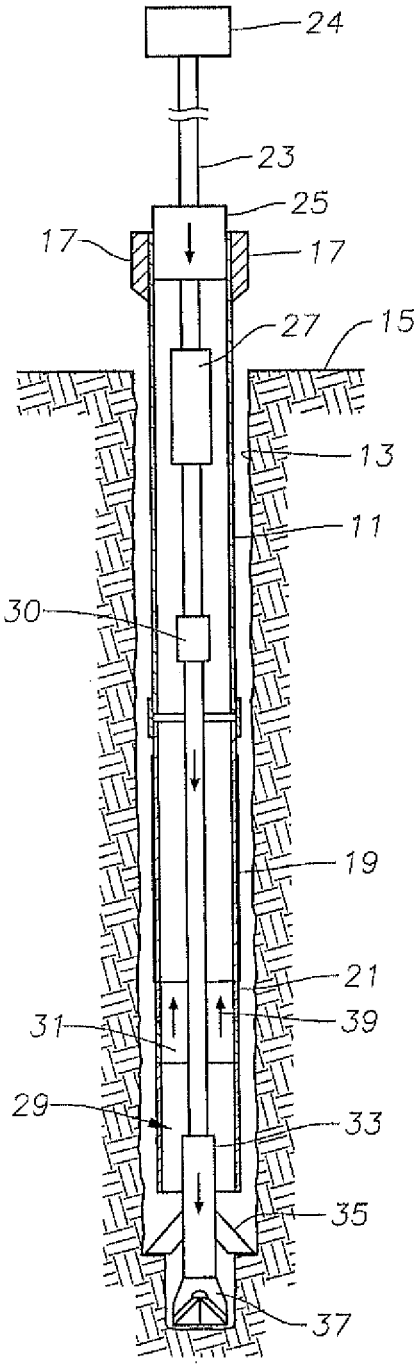
FIG. 1 is a schematic view of a casing string having a fluid diverter and being operated in a drilling mode in accordance with this invention.

Referring to FIG. 1, a casing string 11 is illustrated forming an open hole 13 of a well below seafloor 15. Casing string 11 is made up of sections of casing, each approximately 30 to 40 feet in length, secured together by threads. Although the word "casing" is utilized, casing string 11 may also be considered a liner string. A liner string is made up of well pipe that is the same as casing and is cemented in place, but differs from casing in that the liner upper end will be installed just above the lower end of a previously installed string of casing. The term "casing string" typically refers to well pipe that is cemented in place and extends all the way to a wellhead. The term "casing string" as used herein is meant to include also liner strings. Also, at least some of the techniques described herein are applicable to wells drilled on land locations.

Figure 3:
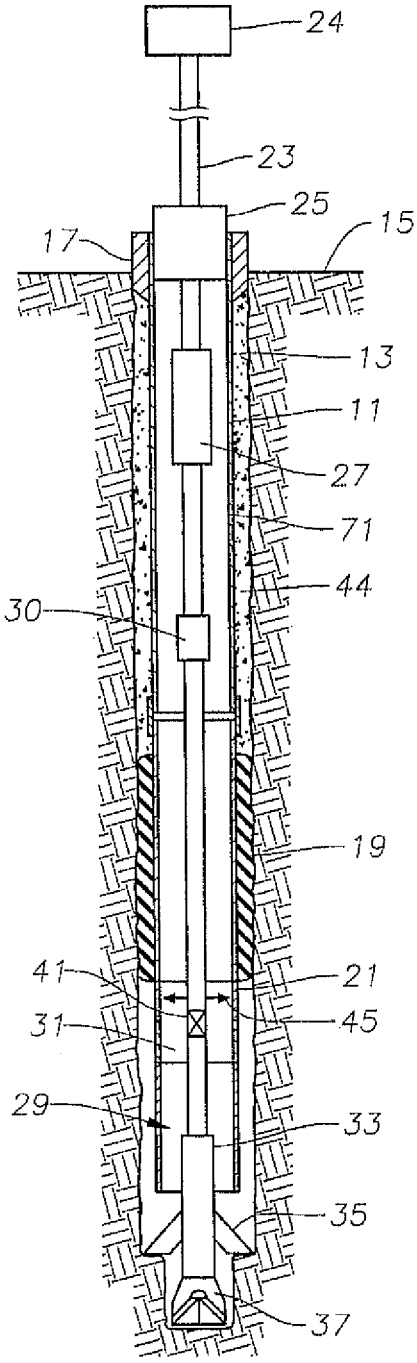
FIG. 3 is a schematic view of the casing string of FIG. 1, showing the cement dispensed and a packer set by the fluid diverter, which is in a packer set position.

In FIG. 1, a wellhead component such as an outer wellhead housing 17, is illustrated at the upper end of casing string 11. After casing string 11 is cemented in place, as shown in FIG. 3, wellhead housing 17 will be at seafloor 15. However, this invention is also applicable to casing strings that extend upward to a platform above sea level, where the wellhead would be located.

Casing string 11 may include a packer 19, which is a conventional elastomeric sleeve, such as an external casing packer, either inflatable or mechanical, that will expand to a larger diameter when set, as illustrated in FIG. 3. When set, packer 19 seals against the borehole wall of borehole 13. Preferably, packer 19 is of a type that remains set once the setting mechanism is energized, even after the setting mechanism has been removed. For example, the setting mechanism may be actuated by fluid pressure, and a device such as a check valve is employed to prevent packer 19 from releasing from the set position after the fluid pressure is removed.

A profile sub 21 is connected in casing string 11 below packer 19 in this embodiment. Profile sub 21 is a tubular member that has grooves or a profile formed in its interior for purposes to be subsequently explained. Profile sub 21 may be located at the lower end of casing string 11, or some of casing string 11 may extend below profile sub 21.

A drill pipe string 23 is shown suspended from a top drive 24 of the drilling rig and inserted concentrically into casing string 11. Top drive 24 is a conventional device employed by many drilling rigs to lift and rotate lengths of drill pipe. Top drive 24 runs up and down a derrick (not shown). An axial locking device 25 is connected into drill pipe string 23 for engaging an upper end of casing string 11 to support the weight of casing string 11. Axial locking device 25 may be a variety of types, including support members or dogs that are actuated radially outward into recesses at the upper end of casing string 11, such as within outer wellhead housing 17. In the preferred embodiment, axial locking device 25 does not transmit rotation to casing string 11 nor receive any torque from it.

A telescoping joint 27 may be located within drill pipe string 23 below lifting device 25. Telescoping joint 27 is a sub that will telescope between various lengths. In this example, it does not transmit any torque in drill pipe string 23 from below to above. However, in an alternate embodiment, it could be configured for transmitting torque through drill pipe string 23.

A bottom hole assembly (BHA) 29 is secured to the lower end of drill pipe string 23 with a stab-in connector 30 located on a central conduit extending upward from BHA 29, BHA 29 includes a fluid diverter 31 that will be subsequently described and which is located below the stab-in connector 30. A mud motor 33 is mounted below fluid diverter 31 within BHA 29. Mud motor 33 is a conventional drilling fluid motor that rotates in response to drilling fluid pumped down drill pipe string 23. An underreamer 35 attaches the lower end of mud motor 33. A drill bit 37 attaches to the lower end of underreamer 35. Underreamer 35 and drill bit 37 are conventional devices for disintegrating the earth formation. Underreamer 35 has arms that will collapse so that it can be retrieved through casing string 11, in the extended position shown in FIG. 1, underreamer 35 has an outer diameter greater than the outer diameter of casing string 11.

Figure 2:
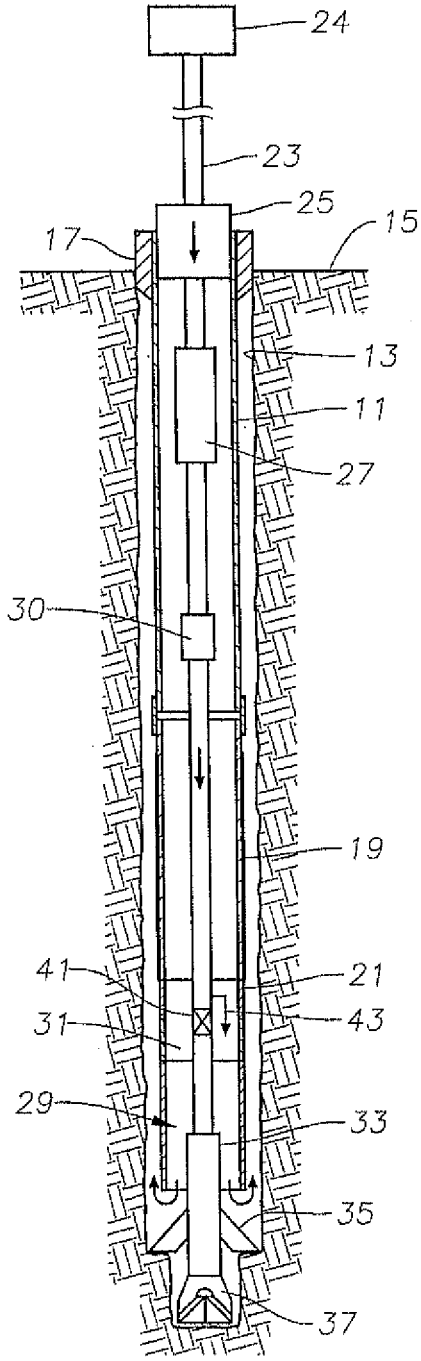
FIG. 2 is a schematic view of the casing string of FIG. 1, showing the fluid diverter in a cementing position.

Fluid diverter 31 has an outer diameter that seals to the inner diameter of casing string 23. Fluid diverter 31 has a drilling mode that allows drilling fluid to flow upwardly through fluid diverter 31 as indicated by arrows 39 in FIG. 1. Fluid diverter 31 also has a cementing mode, as illustrated in FIG. 2. In the cementing mode, a closure member 41 within the passage of drill pipe string 23, blocks any fluid flow to drill bit 37. As indicated by arrow 43, cement being pumped down drill pipe string 23 will flow down into an annulus in casing string 11 surrounding drill pipe string 23 below fluid diverter 31. Cement flow into the drill pipe-casing annulus is also blocked by fluid diverter 31 after it is activated. Fluid diverter 31 also has a packer set mode that is illustrated in FIG. 3. In the packer set mode, fluid pumped down drill pipe string 23 is discharged out to packer 19 to cause it to inflate or set as indicated by arrows 45.

Briefly explaining the operation, prior to running in, BHA 29 is assembled along with fluid diverter 31, packer 19 and stab-in connector 30 and hung off in the rotary table of the drilling rig. Then casing string 11 is assembled on bottom hole assembly 29 and run through the rotary and hung off. Next, drill pipe string 23 together with telescoping joint 27 is run in and stabbed into stab-in connector 30 of bottom hole assembly 29. Telescoping joint 27 allows the required space out by first tagging the mating connector on the lower end of drill pipe string 23 with stab-in connector 30 without making the connection. Then, the properly spaced out drill pipe 23 is connected to the casing running tool 25, which in turn is connected to casing string 11. The assembly of casing 11 can now be run in for BHA 29 to contact the sea floor or the bottom of a previously formed portion of the wellbore.

The operator pumps drilling mud down drill pipe string 23, which discharges out ports in drill bit 37. The drilling fluid also actuates drill motor 33, causing it to rotate underreamer 35 and drill bit 37. In this example, the operator does not rotate drill pipe string 23 with top drive 24. Instead, the operator sizes mud motor 33 so that it has enough torque to cause casing string 11 to spin in reverse to the direction of rotation of drill bit 37. The reaction of the torque created by mud motor 33 transmits through fluid diverter 31 to profile sub 21 of casing string 11 and to drill pipe 23 connected to diverter 31. If casing string 11 were allowed to freely spin, there may be inadequate torque to cause drill bit 37 to rotate and disintegrate the earth formation. The operator thus applies a brake with top drive 24 to cause drill pipe 23 and casing string 11 to rotate more slowly in reverse than the forward rotational speed of drill bit 37. The braking action leaves adequate torque to be applied to drill bit 37 so that it will disintegrate the earth formation and form borehole 13. The rotation of casing string 11 and drill pipe string 23 in reverse is applied to the bottom of casing string 11 and drill pipe string 23, thus it will not cause the pipe connections in casing string 11 or drill pipe string 23 to unscrew. This application of torque results in right hand torque to the pipe connections above the point of application of torque. This reverse rotation of casing string 11 has a beneficial effect of causing casing string 11 to smear and form a mud cake on the sidewall of borehole 13. As the casing string 11 gets deeper within borehole 13, friction will rise, allowing the braking action to be reduced to control the rotational speed in reverse as well as assure adequate torque for rotating drill bit 37 in the forward direction.

As drill bit 37 drills, the drilling fluid discharged has two return paths in this embodiment. One return path is the casing annulus between the sidewall of borehole 13 and the exterior of casing string 11. The other return path is up the interior of casing string 11 through fluid diverter 31 as indicated by arrows 39.

When reaching the total depth as illustrated in FIG. 2, the operator shifts fluid diverter 31 to the cementing mode. In the cementing mode, closure member 41 blocks downward flow from drill pipe string 23 to drill bit 37. Also, in this mode, fluid diverter 31 diverts the downward flow in drill pipe string 23 to the drill pipe annulus surrounding drill pipe string 23 below fluid diverter 31, as indicated by arrow 43. Additionally, diverter 31 shuts off the flow path to the annulus between drill pipe string 23 and casing 11. The operator then pumps cement 44 down drill pipe string 23 to the drill pipe annulus; the cement turns at the bottom of borehole 13 and flows back up the casing annulus, as illustrated in FIG. 3.

When the desired amount of cement 44 has been deployed, in this embodiment, the operator shifts fluid diverter 31 to the packer set position. Closure 41 still prevents downward flow in drill pipe string 23 below fluid diverter 31 to drill bit 37. The operator pumps drilling fluid or water down drill pipe string 23, as indicated by arrows 45. The drilling fluid or water flows out to the inlet ports of packer 19, causing it to set. When set, packer 19 prevents cement 44 from flowing back downward in the casing string annulus before cement 44 cures.

Afterward, the operator releases fluid diverter 31 from profile sub 21 in casing string 11 and retrieves fluid diverter 31, BHA 29 and drill pipe string 23 to the surface. After releasing fluid diverter 31 from profile sub 21, the operator may pump a fluid such as water down drill pipe string 23, which will discharge out the same ports as indicated by arrows 45 but the flow will then be used for cleaning underreamer 35 and drill bit 37.

Figure 4:
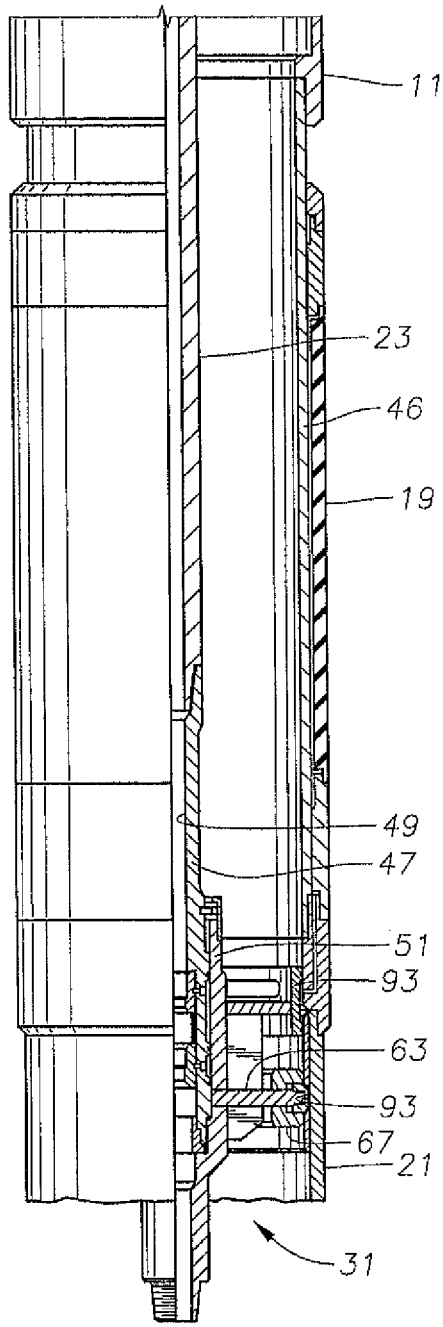
FIG. 4 is a sectional view of the fluid diverter and packer of the casing string of FIG. 1.

A preferred embodiment of fluid diverter 31 is illustrated in FIGS. 4-14. Referring to FIG. 4, packer 19 comprises an elastomeric sleeve mounted over an inner tubular member 46. In one example, ports are provided at the base of packer 19 to allow fluid entry between tubular member 46 and the elastomeric sleeve of packer 19 to cause the sleeve to inflate. Alternately, packer 19 could be a type that has an annular piston on one end that is pushed axially toward the other end in response to fluid pressure to deform the elastomer sleeve radially outward. In each case, packer 19 has a mechanism to hold it in the set position once set.

Fluid diverter 31 has a mandrel 47 with an upper threaded end for connection to a lower end of the drill pipe string 23. The lower end of mandrel 47 also is threaded in this example, for connecting to the remaining portions of BHA 29 (FIG. 1). Mandrel 47 is tubular, having an interior mandrel passage 49 extending from its upper to its lower end.

Figure 14:
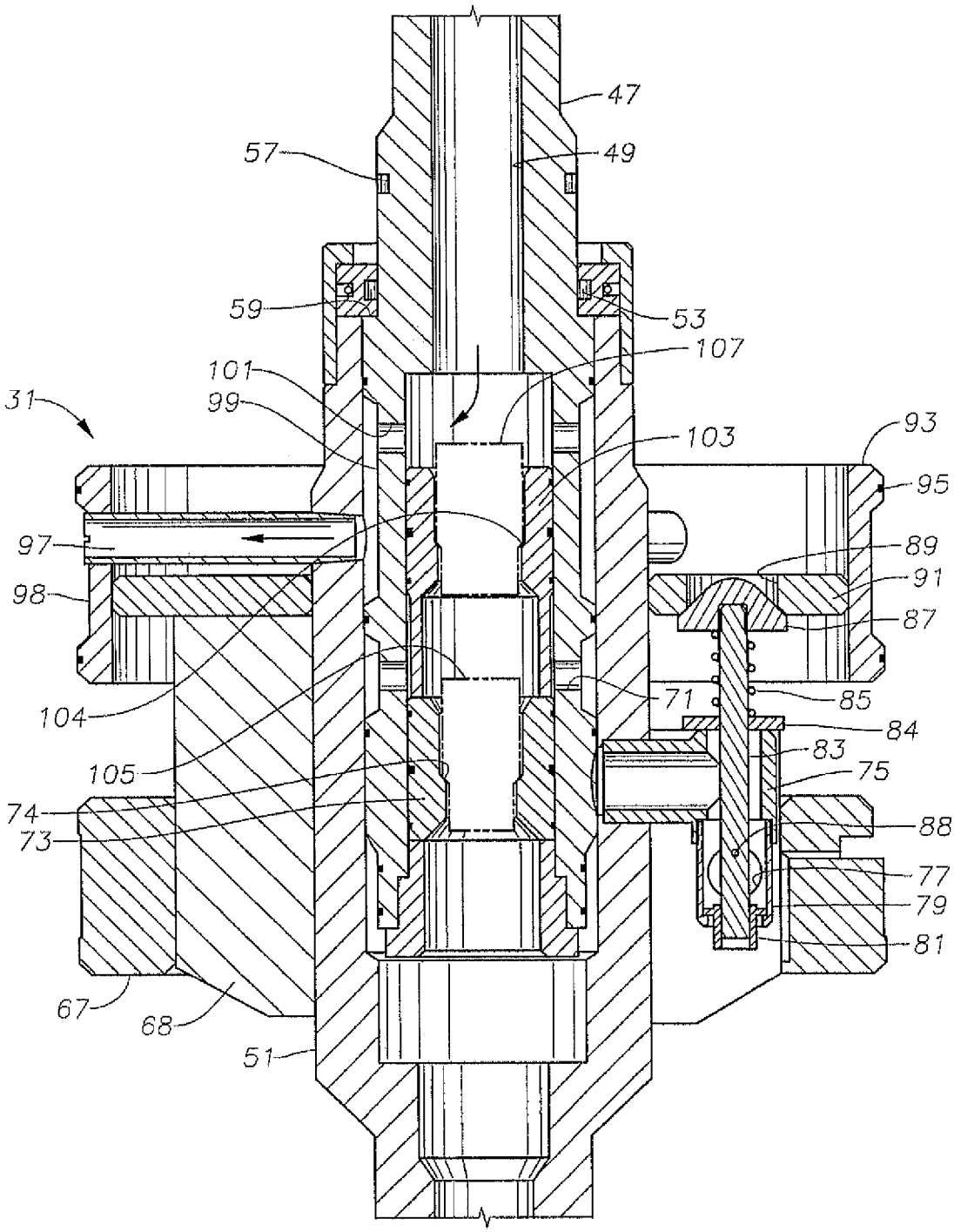
FIG. 14 is a sectional view of the fluid diverter of FIG. 13, and showing the fluid diverter in a retrieval position.

A tubular housing 51 has a central bore that receives mandrel 47. Housing 51 is also carried on mandrel 47 for movement between a lower position (FIG. 14) and an upper position (FIGS. 5-7, 10 and 13). As illustrated in FIG. 6, a shear pin 53 is mounted to a component of housing 51 at its upper end. Shear pin 53 is biased inward by a spring 55 in this example. When moved to the upper position, which is a locked mode, shear pin 53 will snap into engagement with an annular recess 57 extending around mandrel 47. The retrieval position is shown in FIG. 14.

Referring to FIG. 5, mandrel 47 has an exterior cam surface 61. When mandrel 47 and housing 51 are in the locked position shown in FIG. 5, cam surface 61 will be in engagement with the inner ends of a plurality of rods 63. Rods 63 extend radially outward and have outer ends connected to torque keys 65. When pushed outward by rods 63, each torque key 65 engages an axial spline 69 (FIG. 4) in profile sub 21 to transmit torque between profile sub 21 and fluid diverter 31. Additionally, torque keys 65 axially lock diverter 31 to profile sub 21, When running fluid diverter 31 into casing string 11 (FIG. 1), mandrel cam surface 61 will be spaced upward above rods 63, and torque keys 65 will be recessed.

Figure 9:
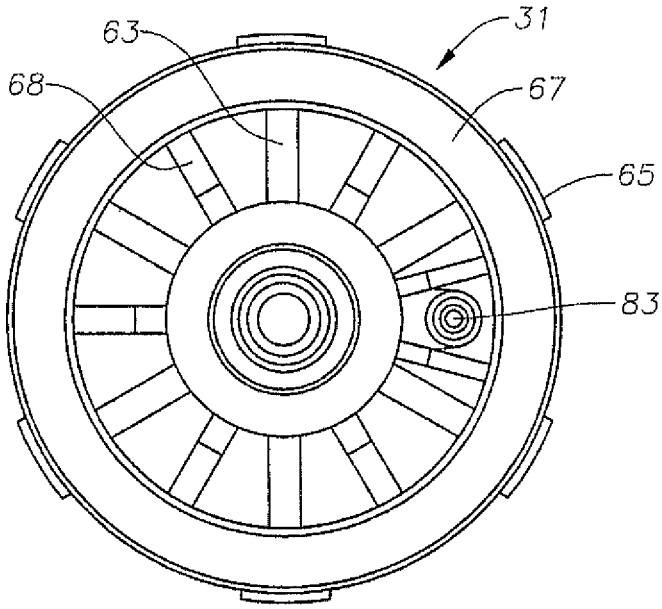
FIG. 9 is a bottom view of the fluid diverter of FIG. 7.

In this example, torque keys 65 are housed within an annular recess on the outer diameter of a lower ring 67. Lower ring 67 extends concentrically around outer housing 51. Lower ring 67 is rigidly secured to outer housing 51 by a plurality of axially extending webs 68. Webs 68 are thin vertical plates that have their inner edges joined to housing 51 and the outer edges joined to the inner diameter of lower ring 67. FIG. 9 illustrates the lower edges of webs 68.

Figure 7:
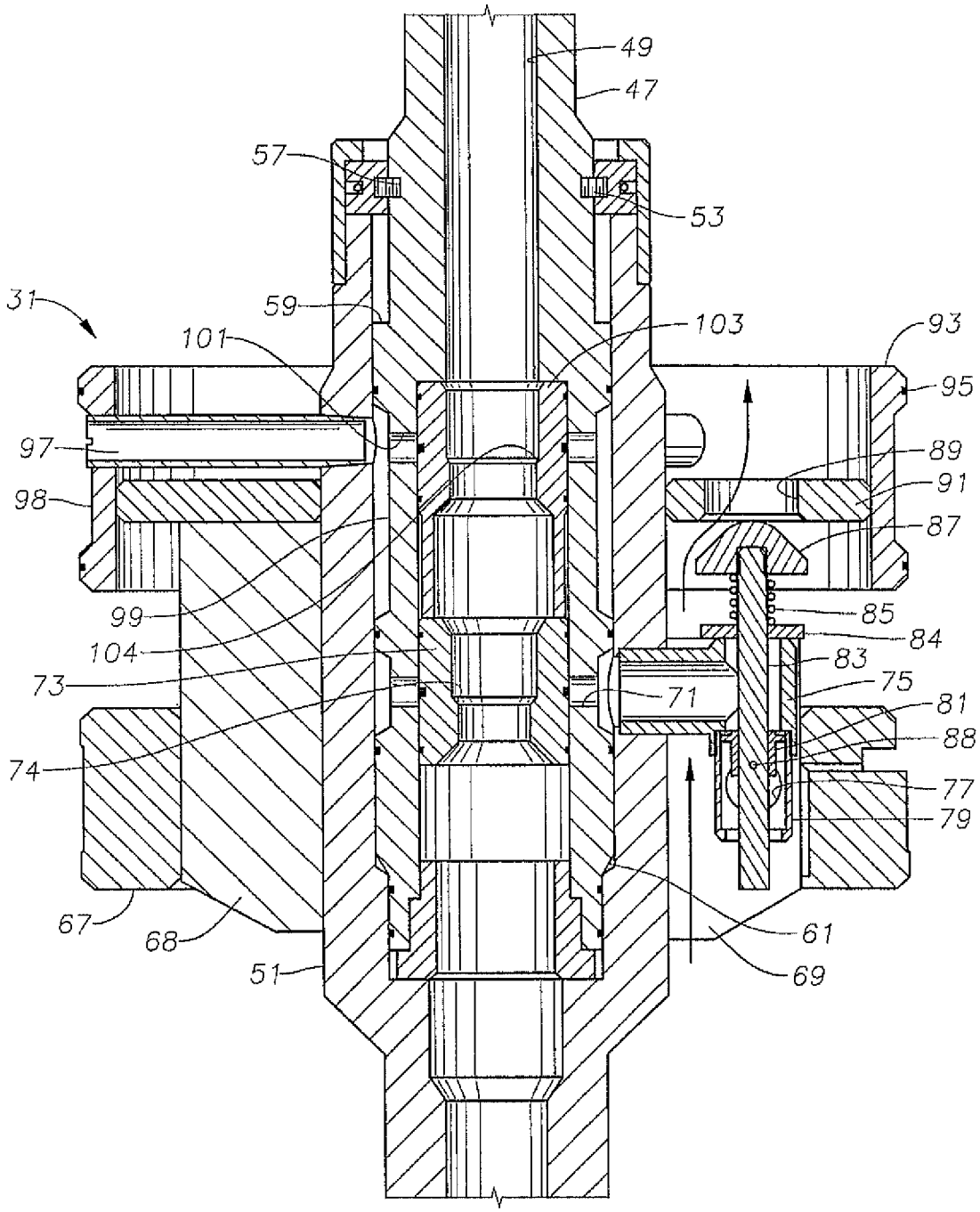
FIG. 7 is a schematic sectional view of the fluid diverter of FIG. 4, and shown in the drilling position.
Figure 10:
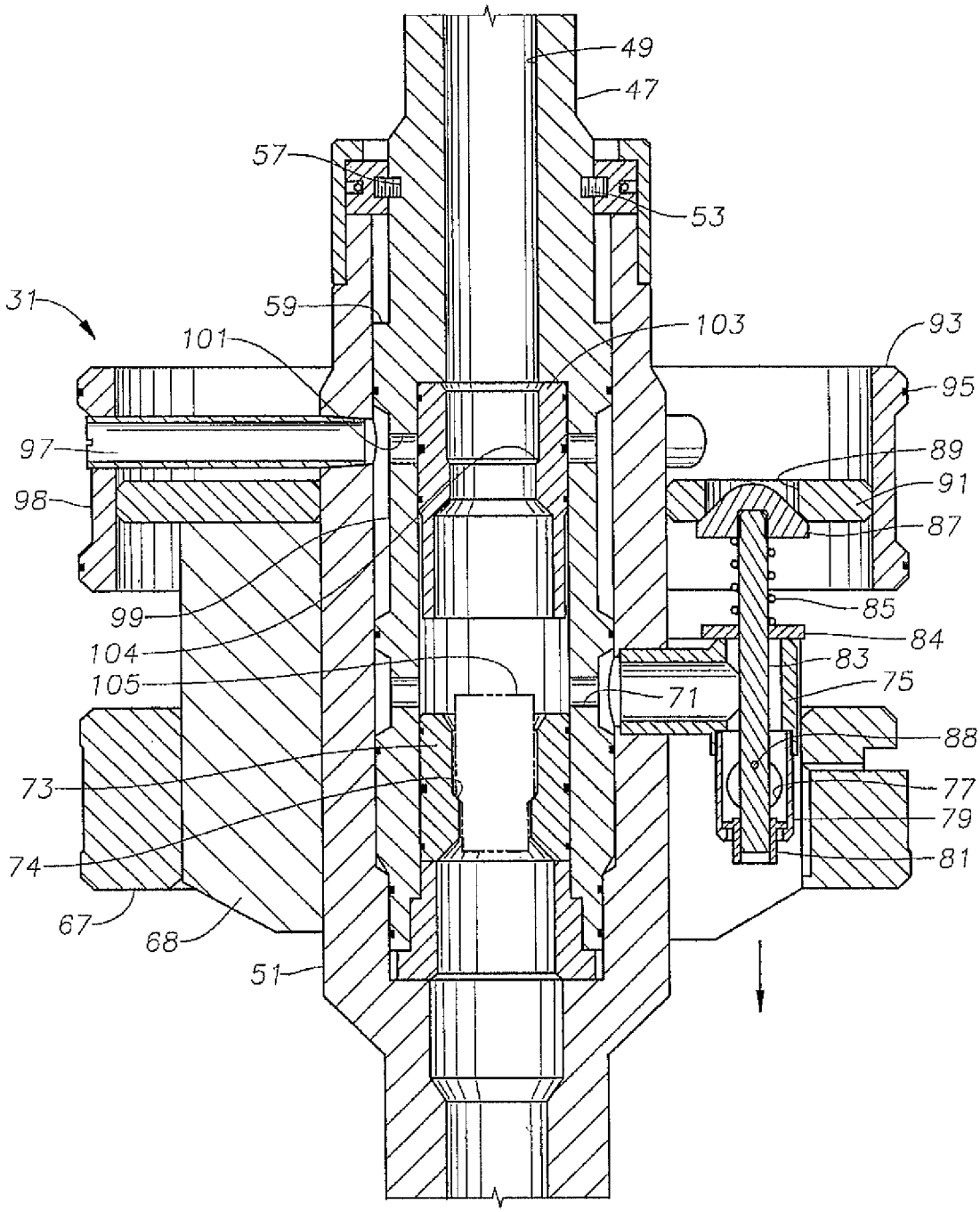
FIG. 10 is another sectional view of the fluid diverter of FIG. 7, showing the fluid diverter in a cementing mode.
Figure 11:
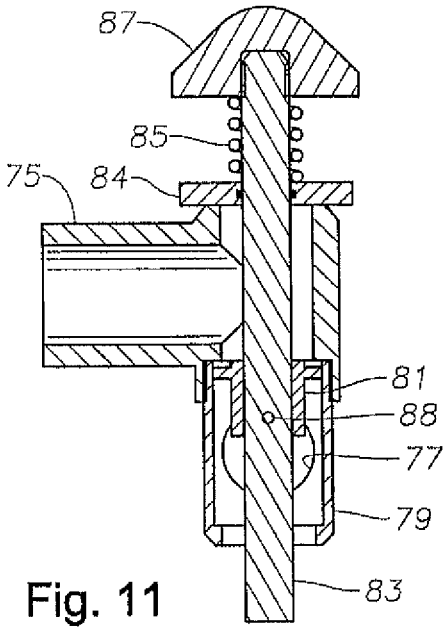
FIG. 11 is a sectional view of the bypass valve of the fluid diverter of FIG. 10, shown removed from the fluid diverter and illustrated in a drilling mode position.
Figure 12:
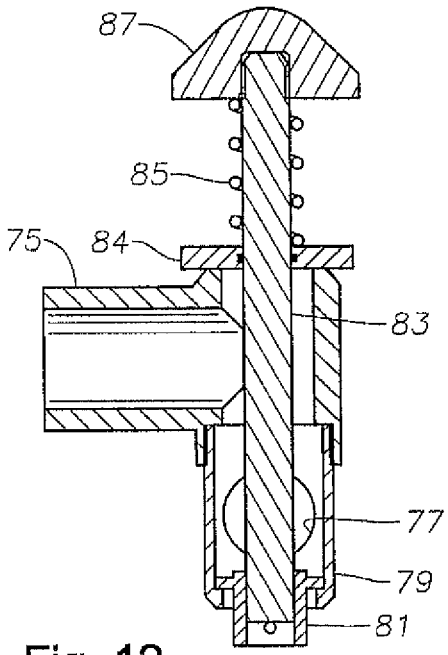
FIG. 12 is a sectional view of the bypass valve of FIG. 11, and showing the bypass valve in a cementing mode.

Referring to FIG. 7, a plurality of cement ports 71 extend radially outward through mandrel 47. The outer ends of cement ports 71 join an annular recess or gallery on the outer diameter of mandrel 47. A cementing valve sleeve 73 is carried within axial passage 49 of mandrel 47 between an upper closed position, which is shown in FIG. 7, and a lower open position which is shown in FIG. 10. In the closed position, cementing valve sleeve 73 blocks flow from passage 49 through cement ports 71. Cementing valve sleeve 73 has an interior passage with a seat 74.

A cement flow tube 75 has a radial portion that extends radially outward through a hole in housing 51 and is in registry with the annular gallery surrounding cement ports 71. Cement flow tube 75 has a cement outlet 77 located within a cylinder 79 that extends downward from an outer end of cement flow tube 75. An annular piston 81 in cylinder 79 moves from an upper position shown in FIGS. 7 and 11 to a lower position shown in FIGS. 10 and 12. Piston 81 has a seal on its outer diameter that seals to the inner diameter of cylinder 79 above cement outlet 77. Piston 81 also has an inner bore that slidingly and sealingly receives a shaft 83.

Shaft 83 extends downward below cylinder 79 and sealingly upward through a cap 84 attached to an upper side of cement flow tube 75. Shaft 83 is urged upward by a coil spring 85 and has a bypass valve member 87 on its upper end. Spring 85 is compressed between cap 84 of cement flow tube 75 and valve member 87, biasing shaft 83 in an upward direction. Valve member 87 and shaft 83 will move upward when moving from the drilling fluid mode position in FIG. 11 to the cementing position in FIG. 12. A shear pin 88 initially secures piston 81 to shaft 83, preventing shaft 83 from moving upward from the position shown in FIG. 11. Fluid pressure applied to the interior of cement flow tube 75 will act against piston 81, and if at a sufficient level, the fluid pressure will shear pin 88. This allows piston 81 to drop by gravity and fluid pressure downward to the position of FIG. 12. It also allows shaft 83 and bypass valve member 87 to move upward to the position of FIG. 12.

When bypass valve member 87 moves upward, it will sealingly engage a bypass port 89 extending through a closure plate 91. Closure plate 91 is mounted in a plane perpendicular to the axis of mandrel 47. Closure plate 91 has an inner diameter sealingly secured to the outer diameter of housing 51. It has an outer diameter that joins an upper ring 93. Upper ring 93 has approximately the same diameter as lower ring 67 and is mounted above it. Upper ring 93 has one or more seals 95 on its outer diameter for sealingly engaging the inner diameter of casing string 11 (FIG. 1). When valve member 87 is in the closed position shown in FIG. 10, no upward flowing fluid within casing string 11 will be able to pass above fluid diverter 31 because of upper ring 93, seals 95 and closure plate 91. While valve member 87 is in the open position shown in FIG. 7, fluid from below fluid diverter 31 is free to flow upward through lower ring 67 around cement flow tube 75 and upward through bypass port 89. FIG. 5 illustrates closure plate 91 and upper ring 93 from a different perspective.

Figure 8:
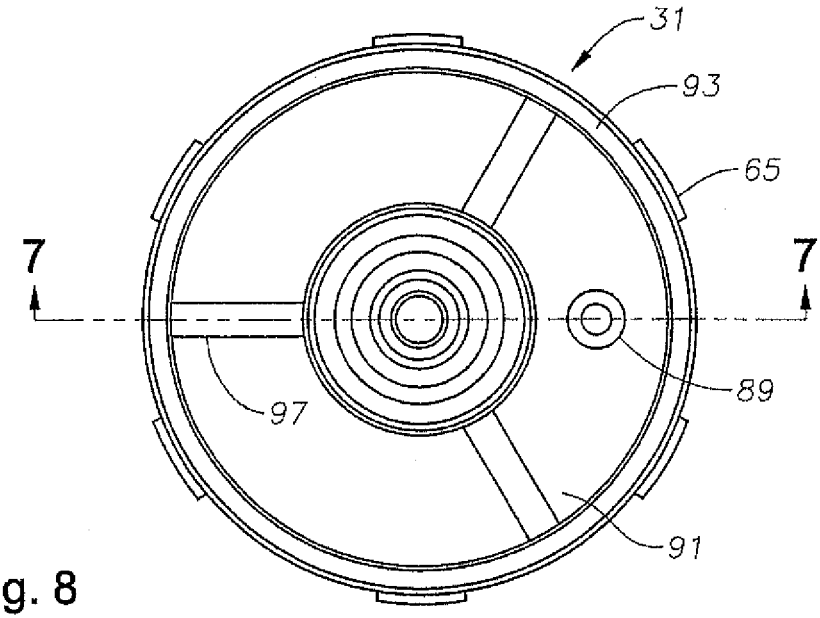
FIG. 8 is a top view of the fluid diverter of FIG. 7.

Referring again to FIG. 7, a packer set or inflate tube 97 is shown extending from the inner diameter of housing 51 radially outward through the outer diameter of upper ring 93. Preferably there are more than one packer inflate tube 97, and FIG. 8 shows three. The outlets of packer inflate tubes 97 are located within a recessed portion of the outer diameter of upper ring 93. Recessed portion 98 has an outer diameter that is less than the outer diameter defined by seals 95. One of the seals 95 is located below the outlet of packer inflate tubes 97 and the other above. Consequently, an annular chamber is achieved between upper ring 93 and casing string 11 to allow fluid pressure to be communicated to an interior port (not shown) of packer 19 (FIG. 4).

Referring still to FIG. 7, mandrel 47 has an annular recess 99 on its exterior that is in fluid communication with the inlets of packer inflate tubes 97. Annular recess 99 has a length selected such that it will be in fluid communication with packer inflate tubes 97 while mandrel 47 is in the lower position relative to housing 51 as shown in FIG. 7 and also while in the upper position as shown in FIG. 14.

Annular recess 99 is in fluid communication with a plurality of packer set or inflate ports 101. Packer inflate ports 101 extend radially through the sidewall of mandrel 47. A packer inflate valve sleeve 103 is sealingly carried within mandrel 47. In the position shown in FIG. 7, packer inflate sleeve 103 blocks any flow from mandrel passage 49 out packer inflate ports 101. When moved to the lower position shown in FIG.

14, downward flowing fluid from mandrel passage 49 passes through packer inflate ports 101 and packer inflate tubes 97. Packer inflate sleeve 103 has an axial passage with a seat 104 that is larger in diameter than seat 74 in cementing valve sleeve 73. Packer sleeve 103 is independently movable relative to cementing valve sleeve 73. Both valve sleeves 73, 104 may be releasably held by shear pins in their initial upper positions shown in FIG. 7.

During operation, the operator then pumps drilling fluid down drill pipe string 23, which flows down mandrel passage 49, through valve sleeves 73 and 103 and out nozzles in drill bit 37 (FIG. 1). The drilling fluid energizes mud motor 33, which rotates drill bit 37. Some of the drilling fluid being discharged flows up the casing string annulus on the exterior of casing string 11. Some of the drilling fluid flows up the interior of casing string 11. Referring to FIG. 7, the returning drilling fluid is able to flow up the interior of casing string 11 because it flows through open bypass port 89.

When the drilling is completed, the operator conveys a first sealing member 105, such as a ball or dart into drill pipe string 23. Preferably the operator pumps drilling fluid, causing first sealing member 105 to land in seat 74 of cement valve sleeve 73, as shown in FIG. 10. First sealing member 105 has a diameter that allows it to pass through seat 104 in packer inflate valve sleeve 103. Increasing the pressure of the drilling fluid shears a shear pin that holds cementing valve sleeve 73 in the upper position, then causes cementing valve 73 to move to the lower position. When first sealing member 105 lands on seat 74, it will block any downward flow from drill pipe string 23 past it. The downward movement of cementing valve sleeve 73 exposes cement ports 71 and diverts fluid flowing down mandrel passage 49 out through cement flow tube 75 to act against piston 81. The fluid pressure shears pin 88, which causes spring 85 to move valve member 87 upward to close port 89. Shearing pin 88 also causes piston 81 to drop down to the lower position, exposing cement outlet 77. The drilling fluid will flow down the interior of casing string 23 around BHA 29, as shown in FIG. 2. The returning drilling fluid now can return only up the exterior annulus of casing string 21 since bypass port 89 is closed. Packer inflate valve sleeve 103 remains in its upper position.

Once circulation is established in this manner, the operator will then pump a quantity of cement 44 (FIG. 3) down drill pipe string 23. Referring again to FIG. 10, the cement flows out cementing outlet 77 and down the interior of casing string 11. Cement 44 flows out the lower end of casing string 11 and back out the casing annulus on the exterior of casing string 11. The closed bypass valve member 87 prevents any cement from flowing upward within casing string 11 above fluid diverter 31.

When the desired quantity of cement has been dispensed, the operator pumps down a second sealing member 107, as illustrated in FIG. 14. Sealing member 107 has a larger outer diameter than sealing member 105 (FIG. 10) thus lands in seat 104 and seals the bore of packer inflate valve sleeve 103. The fluid pressure shears the shear pin holding valve sleeve 103 in the upper position, causing valve sleeve 103 to move downward and expose packer inflate ports 101. The operator pumps drilling fluid of cement down drill pipe string 23, which flows down mandrel passage 49 through packer inflate ports 101 and packer inflate tubes 97. This fluid is employed to inflate or set packer 19 (FIG. 3). Once set, packer 19 stays set, allowing the operator to stop pumping fluid and begin retrieval.

To retrieve, the operator disengages axial locking device 25 (FIG. 1) from outer wellhead housing 17. That step may include partial rotation, downward movement or upward movement or other manipulation of drill pipe string 23. When the operator pulls upward, as shown in FIG. 14, the tension will cause shear pin 53 to shear, allowing mandrel 47 to again move to the upper position relative to housing 51. Torque keys 65 are now free to retract. After releasing and free of the engagement with profile sub 21, the operator may pump drilling fluid down drill pipe string 23 and through mandrel passage 49. Packer inflate tubes 97 are still in fluid communication with packer inflate ports 101 and mandrel passage 49. Consequently, the cleaning fluid is free to discharge and flow within the interior of casing string 11 to clean drill bit 37 and under reamer 35 (FIG. 1).

Figure 15:
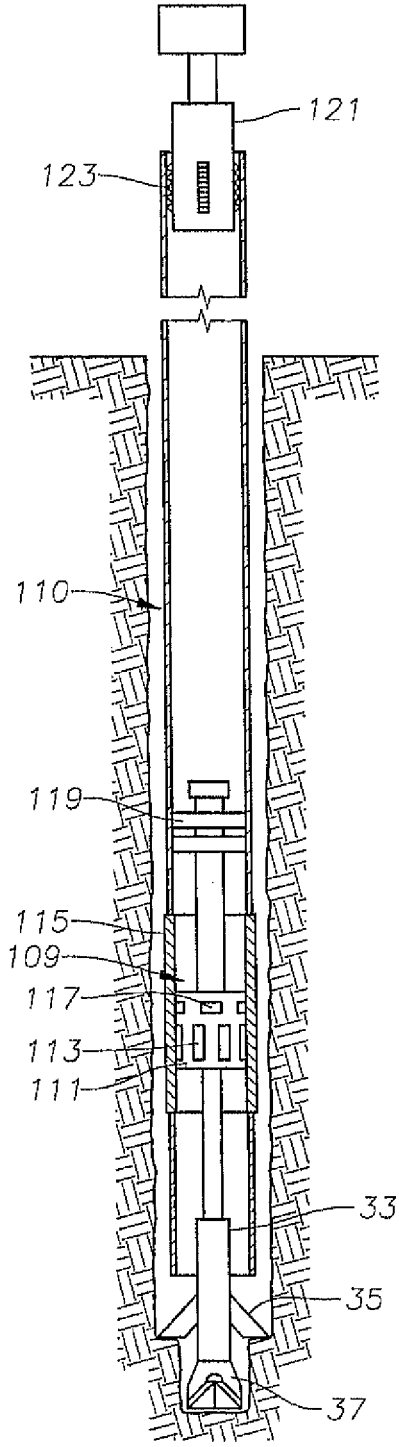
FIG. 15 is a schematic view of an alternate embodiment of a casing string, showing a casing gripper and a bottom hole assembly being operated in accordance with an alternate embodiment method.
Figure 13:
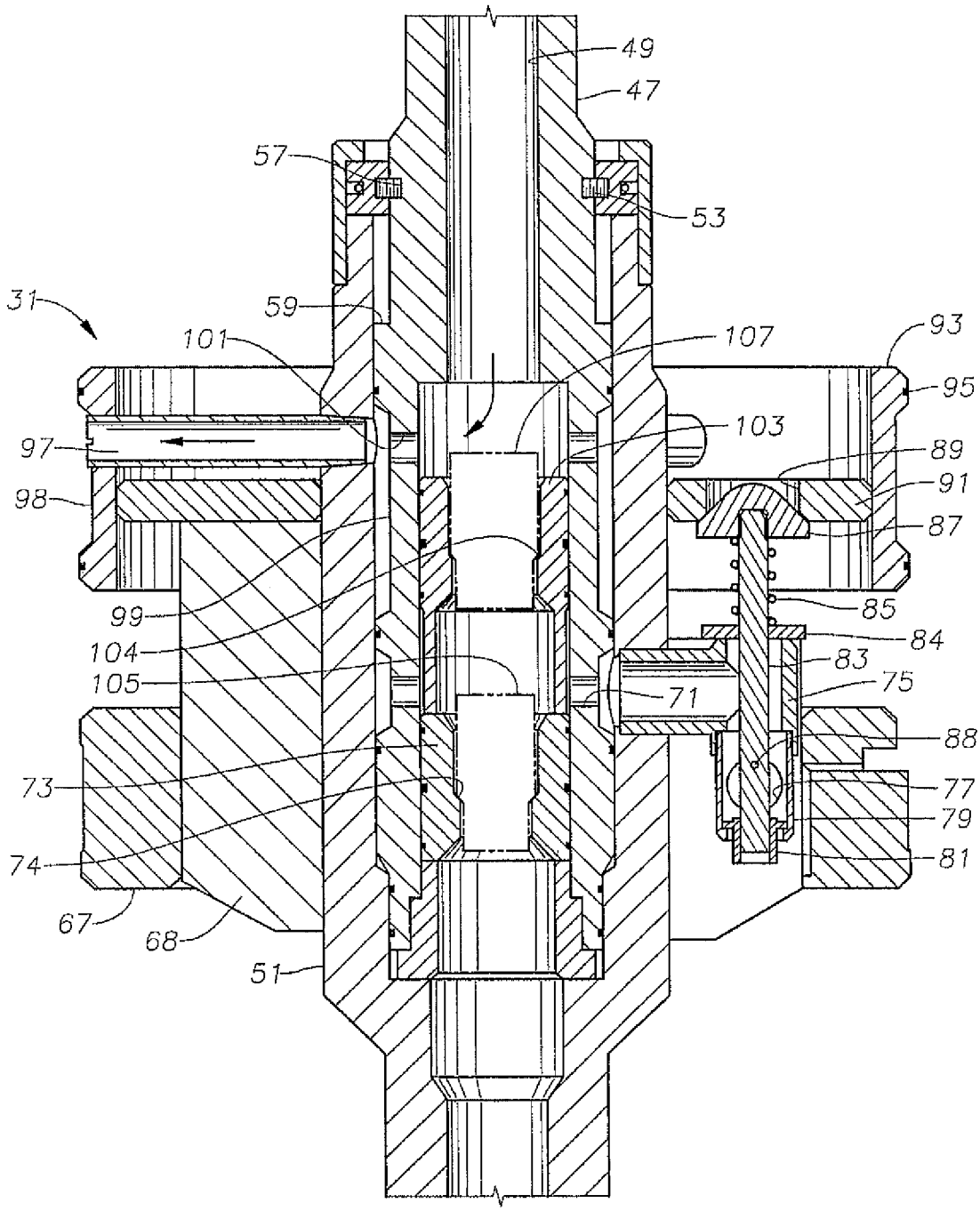
FIG. 13 is a sectional view of the fluid diverter of FIG. 10 and showing the fluid diverter in a packer set position.

FIG. 15 illustrates an alternate embodiment of a feature that allows the casing string 110 to rotate in reverse to the direction of rotation of drill bit 37 when rotated by mud motor 33. Common components are shown by the same numerals. In this embodiment, bottom hole assembly 109 is not located at the lower end of a string of drill pipe during the drilling operation. However, it could be run on the drill pipe and the drill pipe retrieved, if desired. Bottom hole assembly 109 has a locking collar 111 that locks bottom hole assembly 109 to a profile sub 115. Locking collar 111 has torque keys 113 that engage splines in the same manner as torque keys 65 (FIG. 5) of the first embodiment. Locking collar 111 preferably also has axial locking members 117. Axial locking members 117 move radially inward and outward to lock bottom hole assembly 109 to profile sub 115. One or more seals 119 on bottom hole assembly 109 engages the inner diameter of casing string 110. A casing gripper 121 is mounted to top drive 24. Casing gripper 121 has gripping members 123 that will move radially outward to grip the interior of the upper end of casing string 110. Alternately, gripping members 123 could be employed to move radially inward to grip the exterior of casing string 110.

During the operation of FIG. 15, drilling fluid is pumped through top drive 24, casing gripper 121 and down the interior of easing string 110. The drilling fluid flows down bottom hole assembly 109 to cause mud motor 33 to rotate drill bit 37 and underreainer 35 relative to casing string 110. The reactive torque of mud motor 33 is transferred from locking collar 111 to profile sub 115. The reactive torque will tend to cause casing string 110 to rotate in reverse. The operator applies a braking force with top drive 24 to casing gripper 121 to resist rotation to some extent. Some of the torque is allowed to rotate casing string 110 in reverse to the direction of rotation of drill bit 37. As casing string 110 moves deeper into wellbore 13, the frictional effect of casing string 110 against the sidewall of borehole 13 increases. This frictional effect allows the operator to reduce the braking action caused by top drive 24 but still allow some reverse rotation. The technique of FIG. 15 could be applied whether or not a fluid diverter such as fluid diverter 31 is utilized. This technique is applicable both to land and offshore drilling.

While the invention has been shown in only a few of its forms, it should be apparent to those skilled in the art that it is not so limited but is susceptible to various changes without departing from the scope of the invention.

The invention claimed is:

1. A fluid diverter, comprising:

a tubular mandrel with a threaded upper end for connection to a drill pipe string and a lower end for connection to a drill bit assembly, the mandrel having a mandrel passage for receiving fluid pumped down a drill pipe string passage;

a housing surrounding and carried by the mandrel;

a diverter port in the housing having an inlet in fluid communication with the mandrel passage and having an outlet exterior of the housing;

a remotely actuated cementing valve that closes the diverter port while the fluid diverter is in a drilling mode and opens the diverter port while the fluid diverter is in a cementing mode;

a seal assembly mounted to the housing and extending radially therefrom for sealing engagement with an inner diameter of a casing string;

a packer adapted to be connected into the casing string;

a packer set port extending through the mandrel and the housing into fluid communication with the packer; and a remotely actuated packer set valve that closes the packer set port while the fluid diverter is in the drilling and cementing modes and opens the packer set port while in the packer set mode.

2. The fluid diverter according to claim 1, further comprising:

a bypass port in the seal assembly and extending from a lower to an upper side of the seal assembly; and a remotely actuated bypass valve that opens the bypass port while the fluid diverter is in the drilling mode and closes the bypass port while the fluid diverter is in the cementing mode.

3. A fluid diverter, comprising:

a tubular mandrel with a threaded upper end for connection to a drill pipe string and a lower end for connection to a drill bit assembly, the mandrel having a mandrel passage for receiving fluid pumped down a drill pipe string passage;

a housing surrounding and carried by the mandrel;

a diverter port in the housing having an inlet in fluid communication with the mandrel passage and having an outlet exterior of the housing;

a remotely actuated cementing valve that closes the diverter port while the fluid diverter is in a drilling mode and opens the diverter port while the fluid diverter is in a cementing mode;

a packer adapted to be connected into a casing string; and a packer set port extending through the mandrel and the housing into fluid communication with the packer.

4. The fluid diverter according to claim 3, further comprising:

a seal assembly mounted to the housing and extending radially therefrom for sealing engagement with an inner diameter of the casing string;

a bypass port in the seal assembly and extending from a lower to an upper side of the seal assembly; and a remotely actuated bypass valve that opens the bypass port while the fluid diverter is in the drilling mode and closes the bypass port while the fluid diverter is in the cementing mode.

5. The fluid diverter according to claim 3, further comprising:

a remotely actuated packer set valve that closes the packer set port while the fluid diverter is in the drilling and cementing modes and opens the packer set port while in the packer set mode.

6. A fluid diverter, comprising:

a tubular mandrel with a threaded upper end for connection to a drill pipe string and a lower end for connection to a drill bit assembly, the mandrel having a mandrel passage for receiving fluid pumped down a drill pipe string passage;

a housing surrounding and carried by the mandrel;

a diverter port in the housing having an inlet in fluid communication with the mandrel passage and having an outlet exterior of the housing;

a remotely actuated cementing valve that closes the diverter port while the fluid diverter is in a drilling mode and opens the diverter port while the fluid diverter is in a cementing mode;

a seal assembly mounted to the housing and extending radially therefrom for sealing engagement with an inner diameter of a casing string;

a bypass port in the seal assembly and extending from a lower to an upper side of the seal assembly; and a remotely actuated bypass valve that opens the bypass port while the fluid diverter is in the drilling mode and closes the bypass port while the fluid diverter is in the cementing mode.

* * * * *